US011041600B2

(12) United States Patent
Sato

(10) Patent No.: US 11,041,600 B2
(45) Date of Patent: Jun. 22, 2021

(54) LIGHT GUIDE LENS, LENS COUPLING BODY AND LIGHTING TOOL FOR VEHICLE

(71) Applicant: STANLEY ELECTRIC CO., LTD., Tokyo (JP)

(72) Inventor: Koji Sato, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 17/061,226

(22) Filed: Oct. 1, 2020

(65) Prior Publication Data

US 2021/0102681 A1 Apr. 8, 2021

(30) Foreign Application Priority Data

Oct. 8, 2019 (JP) ..... JP2019-185015

(51) Int. Cl.

| | |
|---|---|
| ***F21S 43/241*** | (2018.01) |
| ***F21S 43/243*** | (2018.01) |
| ***F21V 5/04*** | (2006.01) |
| ***F21S 43/247*** | (2018.01) |
| *F21W 103/20* | (2018.01) |

(52) U.S. Cl.

CPC ..... *F21S 43/241* (2018.01); *F21S 43/243* (2018.01); *F21S 43/247* (2018.01); *F21V 5/046* (2013.01); *F21W 2103/20* (2018.01)

(58) Field of Classification Search

CPC ..... F21S 43/241; F21S 43/243; F21S 43/247

See application file for complete search history.

(56) References Cited

U.S. PATENT DOCUMENTS

| | | | | |
|---|---|---|---|---|
| 10,288,248 | B1 * | 5/2019 | Crespin | F21S 43/243 |
| 10,808,902 | B1 * | 10/2020 | Lim | F21S 41/663 |
| 2017/0089541 | A1 * | 3/2017 | Nakajima | B60Q 1/22 |
| 2017/0219181 | A1 * | 8/2017 | Lisowski | B60Q 1/2665 |
| 2018/0038569 | A1 * | 2/2018 | Hanulak | F21S 43/245 |
| 2019/0196090 | A1 * | 6/2019 | Mori | F21S 41/00 |
| 2019/0203905 | A1 * | 7/2019 | Ichinohe | F21S 43/14 |
| 2020/0103087 | A1 * | 4/2020 | Gromfeld | F21V 5/008 |
| 2020/0256540 | A1 * | 8/2020 | Risthaus | F21S 43/239 |

FOREIGN PATENT DOCUMENTS

JP 2016-085827 A 5/2016

* cited by examiner

*Primary Examiner* — Zheng Song
(74) *Attorney, Agent, or Firm* — Kenealy Vaidya LLP

(57) ABSTRACT

Regarding a light guide lens, in cross section in a direction perpendicular to widthwise direction and a direction parallel to optical axis of the light emitted from the light source, a first reflecting section has a first reflecting surface of which inclined angle with respect to the optical axis of light emitted from a light source gradually reduces from a central section in the widthwise direction toward both end portions, and in cross section in a direction parallel to the widthwise direction and a direction parallel to the optical axis of the light emitted from the light source, a second reflecting section has second reflecting surfaces which are inclined in opposite directions with each other toward one side and other side in the widthwise direction with respect to the optical axis of the light emitted from the light source and in which a plurality of reflecting cuts are periodically arranged.

9 Claims, 5 Drawing Sheets

LIGHT GUIDE LENS, LENS COUPLING BODY AND LIGHTING TOOL FOR VEHICLE

CROSS-REFERENCE TO RELATED APPLICATION

Priority is claimed on Japanese Patent Application No. 2019-185015, filed Oct. 8, 2019, the content of which is incorporated herein by reference.

BACKGROUND

Field of the Invention

The present invention relates to a light guide lens, a lens coupling body and a lighting tool for a vehicle.

Description of Related Art

In the related art, as a lighting tool for a vehicle mounted on a vehicle, a lighting tool obtained by assembling a light source such as a light emitting diode (LED) or the like and a light guide lens having a plate shape or the like is known (for example, see Japanese Unexamined Patent Application, First Publication No. 2016-85827).

However, while an LED has high directivity (straightness), an LED also has a property that light cannot be easily diffused. For this reason, in a lighting tool for a vehicle, so-called luminance (emission) non-uniformity in which portions in a light emitting surface (a light emission surface) of a light guide lens, which are in a center at front of the LED and which are surroundings of the optical axis of the LED, emits light more intensely than other portions easily occurs.

Here, in the lighting tool for a vehicle disclosed in Japanese Unexamined Patent Application, First Publication No. 2016-85827, a concave section is provided at a center of the light incident surface of the light guide lens, two convex sections are provided at both sides with the concave section sandwiched therebetween, light entering the concave section among the light from the LED is diffused in a widthwise direction, and light entering the two convex sections is condensed in a direction along a forward/rearward direction. In addition, in the lighting tool for a vehicle disclosed in Japanese Unexamined Patent Application, First Publication No. 2016-85827, a plurality of cut prisms are provided on a light emitting surface of the light guide lens, and light incident from the light incident surface is converted into parallel light in a forward/rearward direction by the plurality of cut prisms. Accordingly, in the light emitting surface of the light guide lens, line-shaped emission with little luminance non-uniformity is realized.

SUMMARY OF THE INVENTION

Incidentally, in the lighting tool for a vehicle disclosed in Japanese Unexamined Patent Application. First Publication No. 2016-85827, a ratio between the dimensions of the light guide lens in a widthwise direction (a leftward/rightward direction) and a depth direction (a forward/rearward direction) is about 1:1. When an emission width of the light emitting surface in the above mentioned light guide lens is increased, it is also necessary to increase a dimension of the light guide lens in the depth direction according to an increase in dimension of the light guide lens in the widthwise direction. In this case, it is difficult to minimize the dimension of the light guide lens in the depth direction and increase only the dimension of the light guide lens in the widthwise direction.

In addition, in the lighting tool for a vehicle disclosed in Japanese Unexamined Patent Application, First Publication No. 2016-85827, when the dimension of the lighting body in the depth direction is reduced, the dimension in the depth direction of the light guide lens disposed inside the lighting body must also be reduced. Accordingly, when a plurality of light guide lenses are disposed inside the lighting body and are arranged in the widthwise direction, it is necessary to increase the number of the light guide lenses disposed in the lighting body as the dimension of the light guide lens in the widthwise direction is reduced. In addition, since the number of the light sources also increases according to an increase in the number of the light guide lenses disposed in the lighting body, this causes an increase in costs. On the other hand, when a large space in which the light guide lenses can be disposed is secured, problems such as an increase in size and the like of the lighting body may occur.

An aspect of the present invention is directed to providing a light guide lens and a lens coupling body in which a dimension in a depth direction is able to be minimized and which enable more uniform light to be guided therethrough in a widthwise direction even when a dimension in the widthwise direction is increased, and a lighting tool for a vehicle including these.

In order to accomplish the above-mentioned purposes, the present invention provides the following means.

[1] A light guide lens including:

a light incidence section on which light emitted from a light source is incident;

a first light guide section, a second light guide section and a third light guide section that are configured to guide the light incident from the light incidence section;

a first reflecting section disposed between the first light guide section and the second light guide section and configured to reflect the light guided into the first light guide section toward the second light guide section; and a second reflecting section disposed between the second light guide section and the third light guide section and configured to reflect the light guided into the second light guide section toward the third light guide section, wherein the light incidence section is disposed on a side of the first light guide section facing the light source and configured to cause the light emitted from the light source to enter the first light guide section while being diffused in a widthwise direction, the first reflecting section reflects the light diffused and guided into the first light guide section in the widthwise direction toward the second light guide section while diffusing the light in the widthwise direction, the second reflecting section reflects the light diffused and guided into the second light guide section in the widthwise direction toward the third light guide section while parallelizing the light, in a cross section in a direction perpendicular to the widthwise direction and a direction parallel to the optical axis of the light emitted from the light source, the first reflecting section has a first reflecting surface of which an inclined angle with respect to the optical axis of the light emitted from the light source gradually reduces from a central section in the widthwise direction toward both end portions, and in a cross section in a direction parallel to the widthwise direction and a direction parallel to the optical axis of the light emitted from the light source, the second reflecting section has second reflecting surfaces which are inclined in opposite directions with each other toward one side and other side in the widthwise direction with respect to the optical axis of the light emitted from the light source and in which a plurality of reflecting cuts are periodically arranged.

[2] The light guide lens according to the above-mentioned [1], wherein the plurality of reflecting cuts are constituted by parabolic reflecting surfaces having focuses at different positions with each other.

[3] The light guide lens according to the above-mentioned [1], wherein the plurality of reflecting cuts are constituted by parabolic reflecting surfaces having a focus at the same position with each other and different F values respectively.

[4] The light guide lens according to any one of the above-mentioned [1] to [3], comprises a light emitting section configured to emit the light, which is parallelized and guided at inside the third light guide section, toward outside.

[5] A lens coupling body including the plurality of light guide lenses according to any one of the above-mentioned [1] to [3], wherein the plurality of light guide lenses have a structure in which they are coupled to each other at a tip side of the third light guide section in a state the plurality of light guide lenses are arranged in the widthwise direction.

[6] The lens coupling body according to the above-mentioned [5], comprises a fourth light guide section coupled to the tip side of the third light guide section in the plurality of light guide lenses, and wherein the fourth light guide section has a light emitting surface continuous in the widthwise direction and emits the light from the light emitting surface of the fourth light guide section, which is disposed on a side opposite to the tip side of the third light guide section, toward the outside.

[7] A lighting tool for a vehicle including: the light guide lens according to any one of the above-mentioned [1] to [4]; and a light source configured to emit light toward the light incidence section of the light guide lens.

[8] A lighting tool for a vehicle including: the lens coupling body according to the above-mentioned [5] or [6]; and a plurality of light sources that is provided to correspond to the plurality of light guide lenses that constitute the lens coupling body, respectively, and that is configured to emit light toward the light incidence section of the light guide lens.

According to the aspects of the present invention, it is possible to provide a light guide lens and a lens coupling body in which a dimension in a depth direction is able to be minimized and which enable more uniform light to be guided therethrough in a widthwise direction even when a dimension in the widthwise direction is increased, and a lighting tool for a vehicle including these.

DETAILED DESCRIPTION OF THE INVENTION

Figure 1:
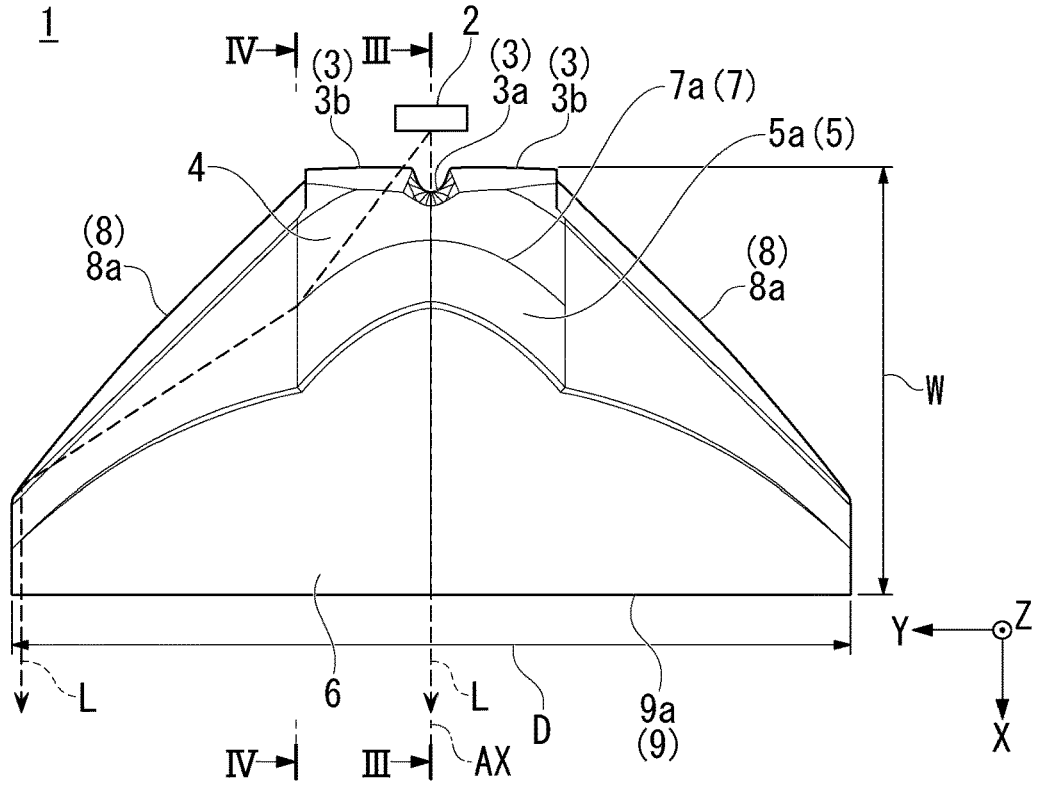
FIG. 1 is a top view showing a configuration of a light guide lens according to a first embodiment of the present invention.

Hereinafter, embodiments of the present invention will be described in detail with reference to the accompanying drawings.

Further, in the drawings used in the following description, in order to make components easier to see, the dimensional scale may vary depending on the components, and dimensional ratios of the components may not be the same as actual ones.

First Embodiment

[Light Guide Lens]

First, as a first embodiment of the present invention, for example, a light guide lens 1 shown in FIG. 1 to FIG. 8 will be described.

Figure 2:
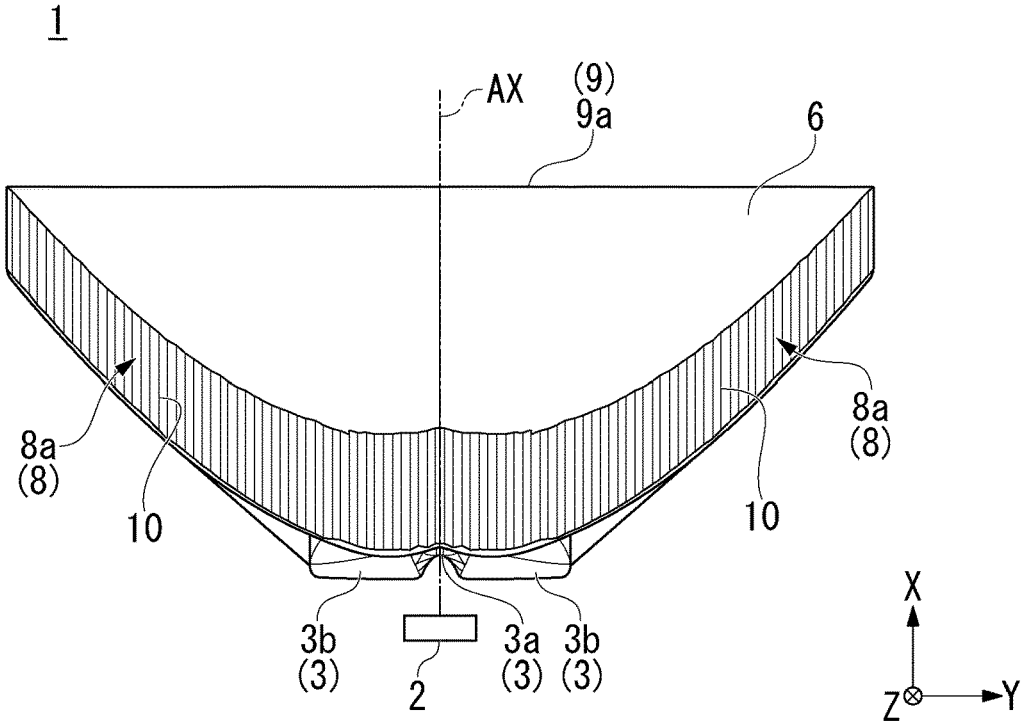
FIG. 2 is a bottom view showing a configuration of the light guide lens shown in FIG. 1.
Figure 3:
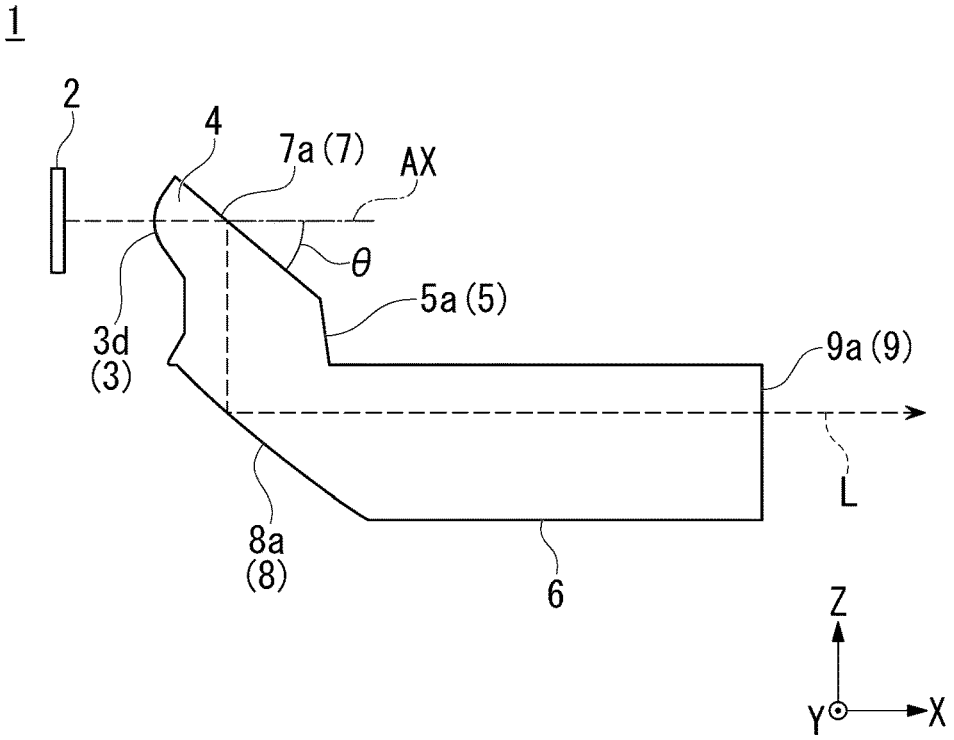
FIG. 3 is a cross-sectional view of the light guide lens taken along line segment III-III shown in FIG. 1.
Figure 4:
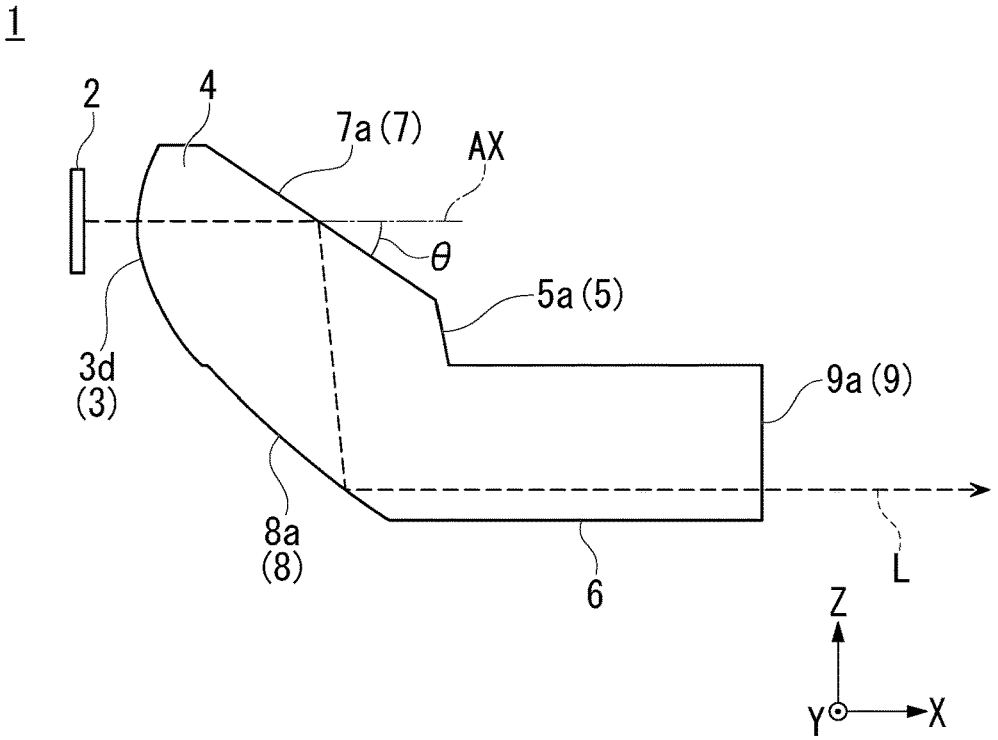
FIG. 4 is a cross-sectional view of the light guide lens taken along line segment IV-IV shown in FIG. 1.
Figure 5:
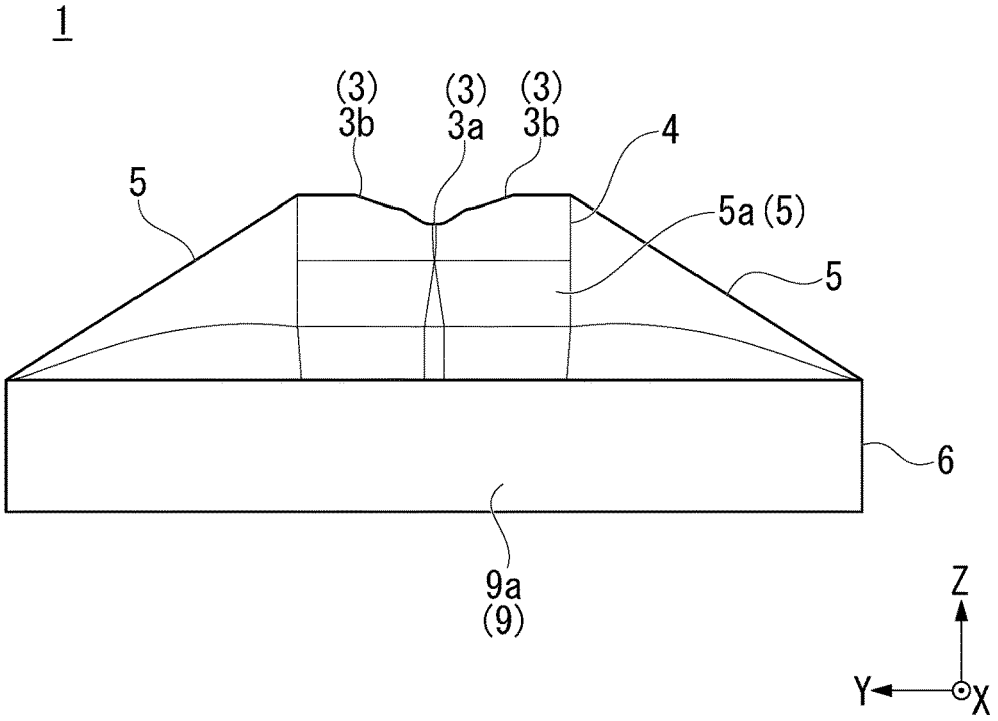
FIG. 5 is a front view showing a configuration of the light guide lens shown in FIG. 1.
Figure 6:
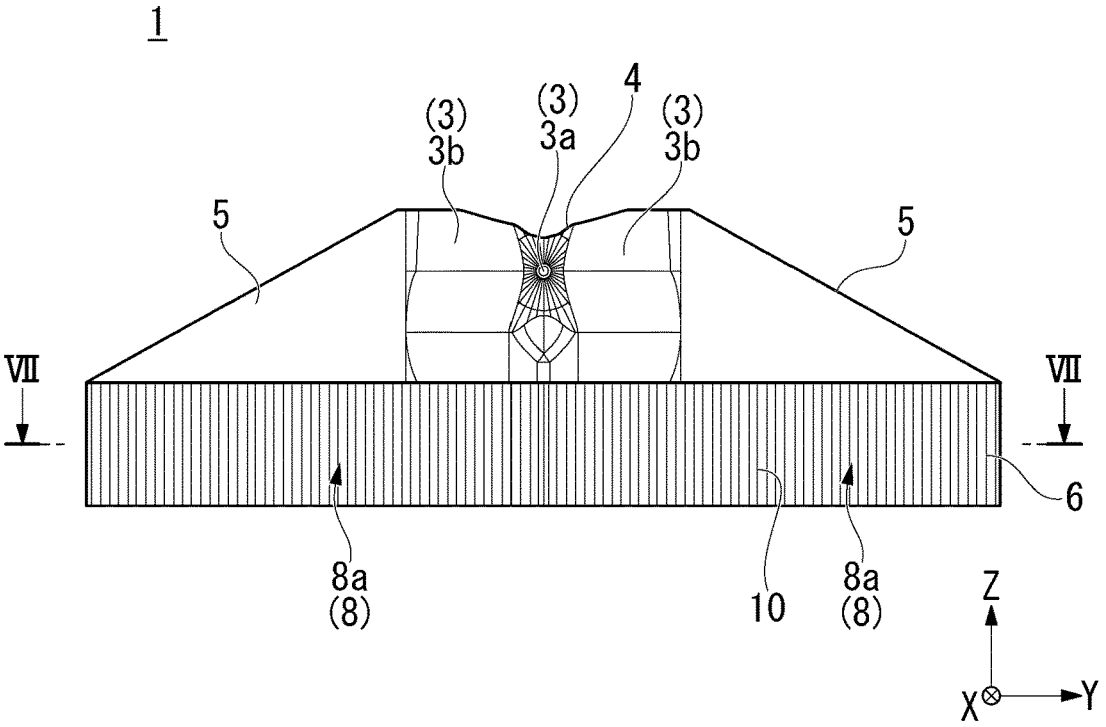
FIG. 6 is a rear view showing a configuration of the light guide lens shown in FIG. 1.
Figure 7:
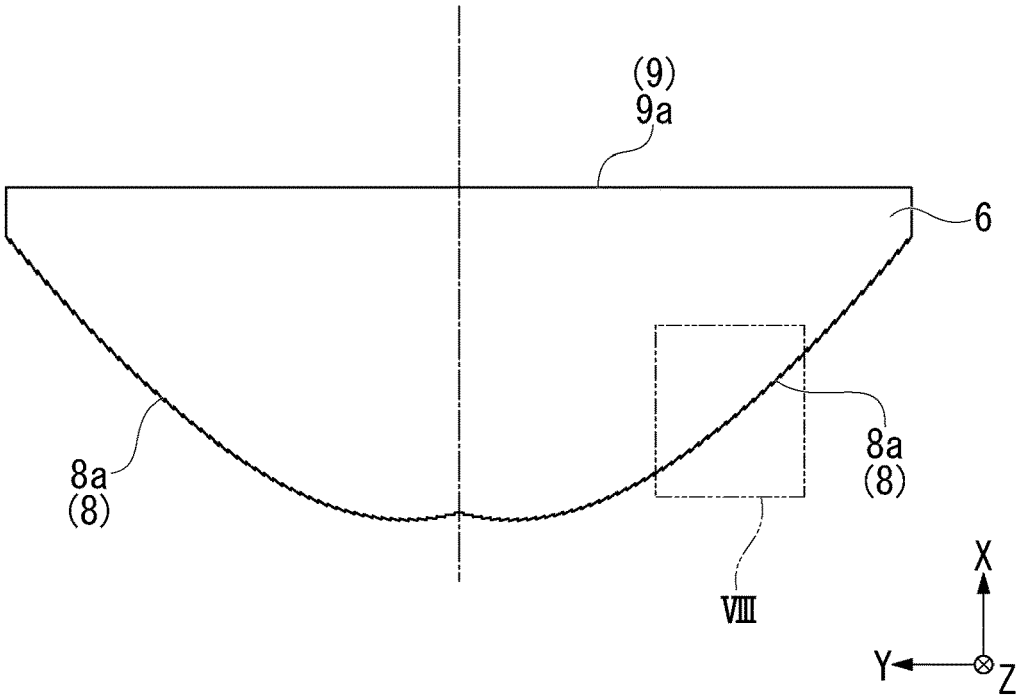
FIG. 7 is a cross-sectional view of the light guide lens taken along line segment VII-VII shown in FIG. 6.
Figure 8:
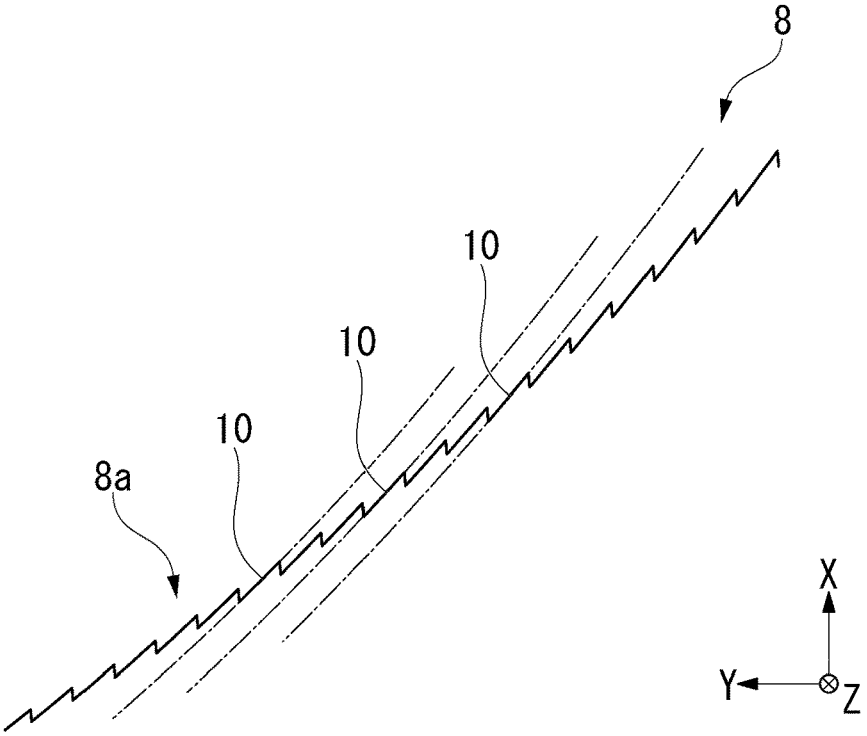
FIG. 8 is a cross-sectional view of a major part of the light guide lens with a box portion VIII shown in FIG. 7 being enlarged.

Further, FIG. 1 is a top view showing a configuration of the light guide lens 1. FIG. 2 is a bottom view showing the configuration of the light guide lens 1. FIG. 3 is a cross-sectional view of the light guide lens 1 taken along line segment III-III shown in FIG. 1. FIG. 4 is a cross-sectional view of the light guide lens 1 taken along line segment IV-IV shown in FIG. 1. FIG. 5 is a front view showing a configuration of the light guide lens. FIG. 6 is a rear view showing a configuration of the light guide lens 1. FIG. 7 is a cross-sectional view of the light guide lens 1 taken line segment VII-VII shown in FIG. 6. FIG. 8 is a cross-sectional view of a major part of the light guide lens 1 while a box portion VIII shown in FIG. 7 is being enlarged.

In addition, in the drawings shown below, an XYZ orthogonal coordinate system is set, an X-axis direction indicates a depth direction (a forward/rearward direction) X in the light guide lens 1, a Y-axis direction indicates a widthwise direction (a leftward/rightward direction) Y in the light guide lens 1, and a Z-axis direction indicates a thickness direction (an upward/downward direction) Z in the light guide lens 1.

As shown in FIG. 1 to FIG. 8, the light guide lens 1 of the embodiment is formed of a light transmissive member configured to guide light L emitted from a light source 2. The light transmissive member may utilize a material having a refractive index higher than that of air, for example, a transparent resin such as polycarbonate, acryl, or the like, glass, or the like.

The light source 2 is constituted by a light emitting diode (LED) configured to emit light L radially. In addition, a high output (high luminance) type LED for illuminating the vehicle (for example, an SMD LED or the like) can be used as the LED. Further, the light source 2 may be configured to radially emit the light L, and may be used as a combination of a light emitting element such as a laser diode (LD) or the like, in addition to the above-mentioned LED, and a fluorescent body.

The light source 2 is mounted on a mounting board (not shown) on the side of one surface (in the embodiment, a front surface). That is, the mounting board is disposed in a state in which one surface side on which the light source 2 is provided is directed forward (a +X-axis side). The light source 2 radially emits the light in a forward direction perpendicular to one surface of the mounting board (the +X-axis side).

Further, the mounting board may have a configuration in which a driving circuit configured to drive the above-mentioned LED is provided. Meanwhile, a configuration in which the mounting board on which the LED is provided and the circuit board on which the driving circuit is provided may be separately provided, and the mounting board and the circuit board may be electrically connected via a wiring cord that is referred to as a harness, and thus, the driving circuit is protected from heat generated from the LED.

The light guide lens 1 of the embodiment has a light incidence section 3 into which the light L emitted from the light source 2 enters, a first light guide section 4, a second light guide section 5 and a third light guide section 6 that are configured to guide the light L entering from the light incidence section 3, a first reflecting section 7 disposed between the first light guide section 4 and the second light guide section 5 and configured to reflect the light L guided into the first light guide section 4 toward the second light guide section 5, a second reflecting section 8 disposed between the second light guide section 5 and the third light guide section 6 and configured to reflect the light L guided into the second light guide section 5 toward the third light guide section 6, and a light emitting section 9 configured to emit the light L guided into the third light guide section 6 toward the outside.

The first light guide section 4 configures a portion provided between the light incidence section 3 disposed on the side of the rear end (a −X axis) thereof and the first reflecting section 7 disposed on the side of the front end (a +X axis) thereof and configured to guide the light L forward (the +X axis side).

The second light guide section 5 configures a portion provided between a tip side (the +X axis) of the first light guide section 4 and a rear end side (the −X axis) side of the third light guide section 6 and configured to guide the light L downward (a −Z axis side).

The third light guide section 6 configures a portion provided between the second reflecting section 8 disposed on the side of the rear end (the −X axis) thereof and the light emitting section 9 disposed on the side of the front end (the +X axis) thereof and configured to guide the light L forward (the +X axis side).

As shown in FIG. 1 and FIG. 2, the third light guide section 6 has a radial shape in which a width gradually increases from the side of the rear end (the −X axis) thereof toward the front end (the +X axis) thereof in a cross section (hereinafter, referred to as "a horizontal cross section") in a direction parallel to a widthwise direction Y of the light guide lens 1 and a direction parallel to an optical axis AX of the light L emitted from the light source 2.

In addition, as shown in FIG. 3 and FIG. 4, the third light guide section 6 has a flat plate shape having a fixed thickness from the side of the rear end (the −X axis) thereof toward the front end (the +X axis) thereof in a cross section (hereinafter, referred to as "a vertical cross section") in a direction perpendicular to the widthwise direction Y of the light guide lens 1 and a direction parallel to the optical axis AX of the light L emitted from the light source 2.

In the light guide lens 1, as shown in FIG. 1, a dimension W in a widthwise direction (a leftward/rightward direction) Y is larger than a dimension D in a depth direction (a forward/rearward direction) X as a whole (W>D). Specifically, in the light guide lens 1 of the embodiment, a dimensional ratio W:D between the dimension W in the widthwise direction Y and the dimension D in the depth direction X is about 2:1.

As shown in FIG. 1, FIG. 2 and FIG. 6, in the horizontal cross section, the light incidence section 3 has a concave lens surface 3*a* curved in a concave shape at a central section on a side facing the light source 2 of the first light guide section 4, and a pair of convex lens surfaces 3*b* and 3*c* curved in a convex shape at both sides in the widthwise direction Y with the concave lens surface 3*a* being disposed therebetween. In addition, the light incidence section 3 has a curved surface (lens surface) shape having a curvature that varies continuously between the concave lens surface 3*a* and the pair of convex lens surfaces 3*b* and 3*c*. In the horizontal cross section, the light incidence section 3 has a shape that is symmetrical with respect to the optical axis AX of the light L emitted from the light source 2.

Accordingly, in the light incidence section 3, the light L radially emitted from the light source 2 enters the first light guide section 4 while being diffused by the concave lens surface 3*a* and the convex lens surfaces 3*b* and 3*c* in the widthwise direction Y. Accordingly, the light L entering the first light guide section 4 from the light incidence section 3 is guided toward the first reflecting section 7 on the forward side (the +X axis side) while being diffused in the widthwise direction Y.

Meanwhile, as shown in FIG. 3 and FIG. 4, the light incidence section 3 has a convex lens surface 3*d* curved in a convex shape in the vertical cross section. In the vertical cross section, the light incidence section 3 has a symmetrical shape with respect to the optical axis AX of the light L emitted from the light source 2 interposed between the surfaces.

Accordingly, in the light incidence section 3, the light L enters the first light guide section 4 to be parallel to the optical axis AX of the light L emitted from the light source 2 while condensing the light L radially emitted from the light source 2 in a thickness direction Z using a convex section 4*d*. Accordingly, the light L guided into the first light guide section 4 is guided toward the first reflecting section 7 on the forward side (the +X axis side) while being parallelized (collimated) in the thickness direction Z.

As shown in FIG. 1 to FIG. 5, the first reflecting section 7 has a first reflecting surface 7*a* configured to (totally) reflect the light L guided into the first light guide section 4 toward the second light guide section 5.

As shown in FIG. 3 and FIG. 4, in the vertical cross section of the first reflecting section 7, the first reflecting surface 7*a* is constituted by an inclined surface inclined downward (toward the −Z axis) at a predetermined angle (hereinafter, referred to as "an inclination angle") 0 with respect to the optical axis AX of the light L emitted from the light source 2.

In addition, an inclination angle θ of the first reflecting surface 7*a* gradually reduces from a central section of the first reflecting section 7 in the widthwise direction Y toward both end portions. For example, in the embodiment, in the central section of the first reflecting surface 7*a* in the widthwise direction Y shown in FIG. 3 (a position shown by line segment III-III in FIG. 1), the inclination angle θ of the first reflecting surface 7*a* is about 42°. On the other hand, in the end portion of the first reflecting surface 7*a* in the widthwise direction Y shown in FIG. 4 (a position shown by line segment IV-IV in FIG. 1), the inclination angle θ of the first reflecting surface 7*a* is about 35°.

Meanwhile, as shown in FIG. 1, the first reflecting surface 7*a* is constituted by a curved surface that is curved rearward (the −X axis side) in a convex shape in the horizontal cross section of the first reflecting section 7. The first reflecting surface 7*a* has a symmetrical shape with respect to the optical axis AX of the light L emitted from the light source 2 in the horizontal cross section of the first reflecting section 7.

Accordingly, in the first reflecting section 7, as shown in FIG. 1. FIG. 3 and FIG. 4, the light L diffused and guided into the first light guide section 4 in the widthwise direction Y is reflected toward the second light guide section 5 while being diffused by the first reflecting surface 7*a* in the widthwise direction Y. Accordingly, the light L guided into the second light guide section 5 is guided toward the second reflecting section 8 on the downward side (the −Z axis side) while being diffused in the widthwise direction Y more than the light L guided into the first light guide section 4.

In addition, in the first reflecting section 7, since the inclination angle θ of the first reflecting surface 7*a* gradually reduces from the central section in the widthwise direction Y toward both end portions (the first reflecting surface 7*a* is a gently inclined surface), a distance (an optical path length) until the light L reflected by the first reflecting surface 7*a* enters the second reflecting section 8 can be made so as to gradually increase from the central section of the first reflecting surface 7*a* in the widthwise direction Y toward both end portions.

For example, in the embodiment, the light L reflected by the central section of the first reflecting surface 7*a* in the widthwise direction Y shown in FIG. 3 (the position shown by line segment III-III in FIG. 1) enters an upper (the +Z axis) side of the second reflecting section 8. On the other hand, the light L reflected by the end portion of the first reflecting surface 7*a* in the widthwise direction Y shown in FIG. 4 (the position shown by line segment IV-IV in FIG. 1) enters a lower (the +Z axis) side of the second reflecting section 8.

Accordingly, in the first reflecting section 7, the light L reflected by the first reflecting surface 7*a* can be guided from the rear end side of the second reflecting section 8 (to be described below) toward the front end side over a large area.

As shown in FIG. 3 and FIG. 4, in the vertical cross section of the second light guide section 5, a front surface 5*a* of the second light guide section 5 is constituted by an inclined surface inclined at a steeper angle than the first reflecting surface 7*a* so as not to interfere with the light L guided into the second light guide section 5.

In addition, as shown in FIG. 1 and FIG. 5, in the horizontal cross section of the second light guide section 5, the front surface 5*a* of the second light guide section 5 is constituted by a curved surface that is curved rearward in a convex shape (the −X axis side) along a shape of the first reflecting surface 7*a* so as not to interfere with the light L guided into the second light guide section 5.

As shown in FIG. 1 to FIG. 4 and FIG. 6, the second reflecting section 8 has a second reflecting surface 8*a* configured to (totally) reflect the light L guided into the second light guide section 5 toward the third light guide section 6.

As shown in FIG. 3 and FIG. 4, in the vertical cross section of the second reflecting section 8, the second reflecting surface 8*a* is constituted by an inclined surface inclined forward (the +X axis side) according to the inclination angle θ of the first reflecting surface 7*a*.

Meanwhile, as shown in FIG. 2 and FIG. 6, in the horizontal cross section of the second reflecting section 8, the second reflecting surface 8*a* is inclined in opposite directions with each other toward one side and the other side in the widthwise direction Y with respect to the optical axis AX of the light L emitted from the light source 2. The second reflecting surface 8*a* has a symmetrical shape with respect to the optical axis AX of the light L emitted from the light source 2 in the horizontal cross section of the second reflecting section 8.

In addition, the second reflecting surface 8*a* has a shape curved from the rear end (the −X axis) side of the second reflecting section 8 disposed at a central section in the widthwise direction Y toward the front end (the +X axis) side of the second reflecting section 8 disposed at both end portions in the widthwise direction Y according to a radial shape of the third light guide section 6.

A plurality of reflecting cuts 10 extending in the thickness direction Z of the third light guide section 6 are provided on the second reflecting surface 8*a* to be arranged periodically in the widthwise direction Y. As shown enlarged in FIG. 8, each of the reflecting cuts 10 is constituted by a parabolic reflecting surface curved in a concave shape to describe a parabola in the horizontal cross section of the second reflecting section 8. In addition, the plurality of reflecting cuts 10 are constituted by parabolic reflecting surfaces having focuses at different positions with each other.

Accordingly, in the second reflecting section 8, as shown in FIG. 1, FIG. 3 and FIG. 4, the light L diffused and guided into the second light guide section 5 in the widthwise direction Y is reflected by the third light guide section 6 to be parallel to the optical axis AX of the light L emitted from the light source 2 while being condensed by the plurality of reflecting cuts 10 in the widthwise direction Y. Accordingly, the light L guided into the third light guide section 6 is guided toward the light emitting section 9 on the front side (the +X axis side) while being parallelized (collimated) in the widthwise direction Y.

Further, in the embodiment, while the plurality of reflecting cuts 10 are constituted by the parabolic reflecting surfaces having focuses at different positions, dissimilar to this, the plurality of reflecting cuts 10 may be constituted by parabolic reflecting surfaces having the same focus at the same position with each other and having different F values respectively.

As shown in FIG. 1 to FIG. 5, the light emitting section 9 has a light emitting surface 9*a* configured to emit the light L guided into the third light guide section 6 toward the outside. The light emitting surface 9*a* is constituted by a flat surface located on a front surface of a portion extending from the front end side (the +X axis side) of the third light guide section 6 with a fixed width and parallel to the vertical cross section of the light emitting section 9.

Accordingly, in the light emitting section 9, the light L, which is parallelized (collimated) and guided at inside the third light guide section 6, is emitted from the light emitting surface 9*a* on the front side (the +X axis side) toward the outside. Accordingly, the light emitting surface 9*a* may be used as the light emission surface of the light guide lens 1 to emit light in a linear shape.

In the light guide lens 1 of the embodiment having the above-mentioned configuration, the light L emitted from the light source 2 enters the first light guide section 4 while being diffused by the light incidence section 3 in the widthwise direction Y. In addition, the light L diffused and guided into the first light guide section 4 in the widthwise direction Y is reflected toward the second light guide section 5 while being diffused by the first reflecting section 7 in the widthwise direction Y. The light L diffused and guided into the second light guide section 5 in the widthwise direction Y is reflected toward the third light guide section 6 while being parallelized (collimated) by the second reflecting section 8. In addition, the light L parallelized (collimated) and guided into the third light guide section 6 is emitted from the light emitting section 9 to the outside.

Accordingly, in the light guide lens 1 of the embodiment, even when the dimension W in the widthwise direction Y is increased while minimizing the dimension D in the depth direction X, the light L can be more uniformly guided throughout in the widthwise direction Y. Accordingly, in the light guide lens 1 of the embodiment, line-shaped emission with small luminance non-uniformity in the light emitting surface 9*a* is possible.

Second Embodiment

[Lens Coupling Body and Lighting Tool for a Vehicle]

Next, as a second embodiment of the present invention, for example, a lighting tool 100 for a vehicle including a lens coupling body 50 shown in FIG. 9 and FIG. 10 will be described.

Figure 9:
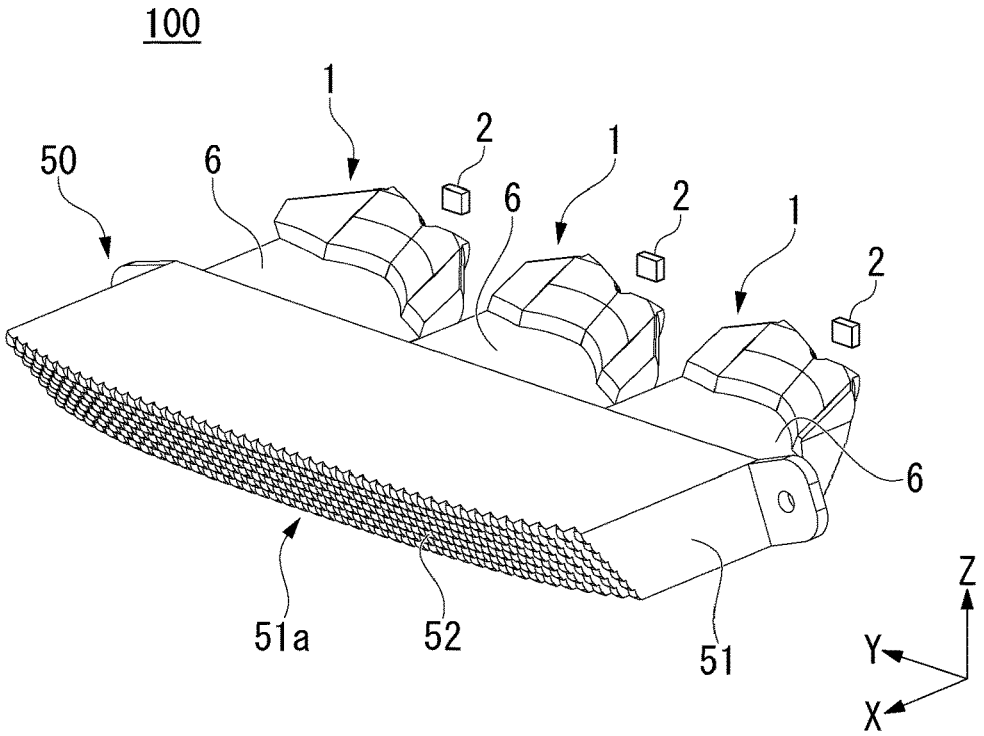
FIG. 9 is a perspective view showing a lighting tool for a vehicle including a lens coupling body according to a second embodiment of the present invention from above.

Further, FIG. 9 is a perspective view showing the lighting tool 100 for a vehicle including the lens coupling body 50 from above. FIG. 10 is a perspective view showing the lighting tool 100 for a vehicle including the lens coupling body 50 from below. In addition, in the following description, components the same as those in the light guide lens 1 are designated by the same reference signs in the drawings, and description thereof will be omitted.

The lighting tool 100 for a vehicle including the lens coupling body 50 of the embodiment is mounted on, for example, each of both corner sections on a front end side of a vehicle (not shown), and the present invention is applied to a direction indicator (a turn lamp) that flashes on and off with orange emission. For this reason, in the embodiment, an LED configured to emit orange light (hereinafter, simply referred as light) L is used as the light source 2.

Figure 10:
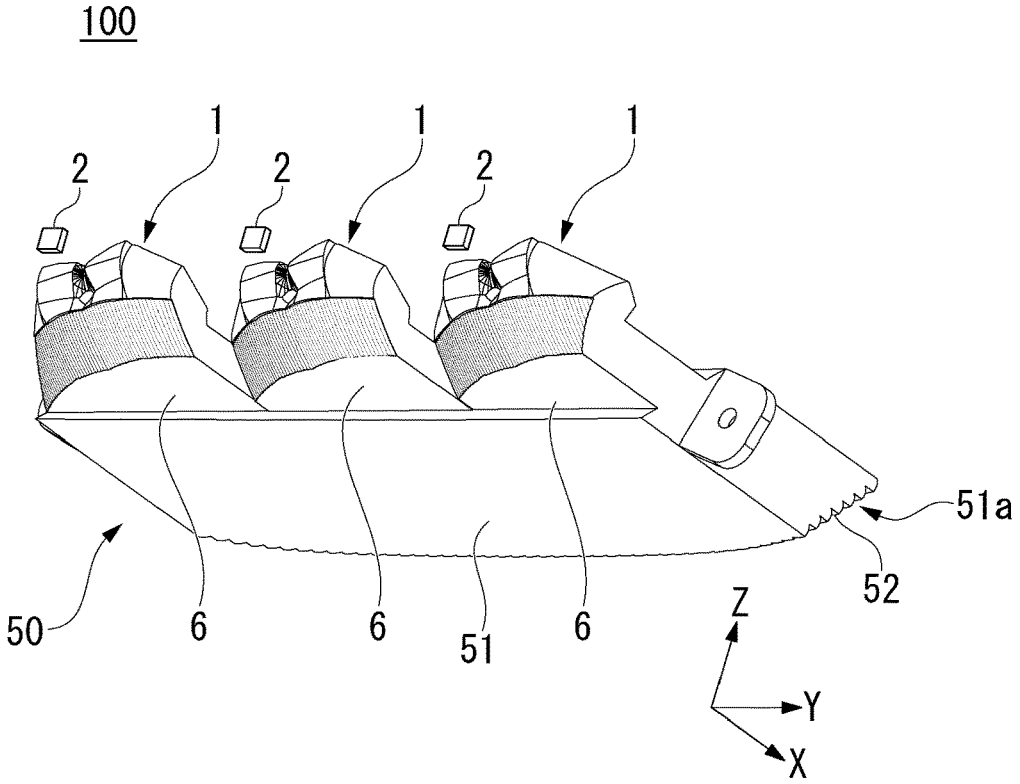
FIG. 10 is a perspective view showing the lighting tool for a vehicle including the lens coupling body shown in FIG. 9 from below.

Specifically, as shown in FIG. 9 and FIG. 10, the lighting tool 100 for a vehicle includes a lens coupling body 50 obtained by coupling a plurality of (in the embodiment, three) light guide lens 1 and a plurality of (in the embodiment, three) light sources 2 provided to correspond to the plurality of light guide lenses 1 that constitute the lens coupling body 50 inside a lighting body (not shown).

Further, the lighting body is constituted by a housing having an opening formed in a front surface thereof, and a transparent lens cover configured to cover the opening of the housing. In addition, a shape of the lighting body can be appropriately changed according to a design of the vehicle.

The lens coupling body 50 has a structure in which the plurality of light guide lenses 1 are coupled to each other on a tip side (the +X axis side) of the third light guide section 6 while being arranged in the widthwise direction Y. Specifically, the lens coupling body 50 includes a fourth light guide section 51 coupled to a tip side (the +X axis side) of the third light guide section 6 in the plurality of light guide lenses 1.

The fourth light guide section 51 constitutes a portion configured to guide the light L guided from the light guide lenses 1 forward (the +X axis side). The fourth light guide section 51 has a flat plate shape extending from a front end side (the +X axis side) of the third light guide section 6 parallel to the widthwise direction Y of the plurality of light guide lenses 1 with a fixed width and thickness.

The fourth light guide section 51 has a light emitting surface 51*a* disposed at a side opposite to a tip side (the +X axis side) of the third light guide section 6 and configured to emit the light L guided from the light guide lenses 1 toward the outside. The light emitting surface 51*a* constitutes a surface continuous in the widthwise direction Y on the front end (the +X axis) side of the fourth light guide section 51.

In addition, a plurality of diffusion cuts 52 configured to diffuse the light L emitted outward from the light emitting surface 51*a* in the widthwise direction Y are provided on the light emitting surface 51*a*. As the diffusion cuts 52, a concavo-convex structure or the like formed by performing, for example, lens cutting referred to as flute cutting or fisheye cutting, knurling, emboss processing, or the like, can be exemplified. In addition, in the light emitting surface 51*a*, a diffusion level of the light emitted from the light emitting surface 51*a* can be controlled by adjusting a shape or the like of the diffusion cuts 52.

In the lens coupling body 50 of the embodiment having the above-mentioned configuration, the light L parallelized (collimated) and guided into the third light guide section 6 of the light guide lens 1 is emitted from the light emitting surface 51*a* on the front side (the +X axis side) toward the outside while being guided into the fourth light guide section 51. Accordingly, it is possible to use the light emitting surface 51*a* to emit light in a linear shape as the light emission surface of the lens coupling body 50.

In addition, in the lighting tool 100 for a vehicle including the lens coupling body 50, it is possible to emit orange light using the turn lamp while substantially uniformly blinking an emission area corresponding to the light emitting surface 51*a*.

As described above, in the lighting tool 100 for a vehicle of the embodiment, in the plurality of light guide lenses 1, even when the dimension W in the widthwise direction Y is increased while minimizing the dimension D in the depth direction X, since the light L can be more uniformly guided throughout in the widthwise direction Y, line-shaped emission with small luminance non-uniformity in the light emitting surface 51*a* of the lens coupling body 50 is possible.

Further, the present invention is not necessarily limited to the embodiments and various modifications may be made without departing from the scope of the present invention.

For example, in the lighting tool 100 for a vehicle, a shape or the like of the light guide lens 1 or the lens coupling body 50 can be appropriately changed according to a design or the like of the actual vehicle.

In addition, in the light guide lens 1, while the second reflecting section 8 has a configuration having the second reflecting surface 8*a* on which the plurality of reflecting cuts 10 are arranged periodically, a configuration in which the plurality of reflecting cuts 10 are omitted may be provided.

In addition, in the lighting tool 100 for a vehicle, while the configuration including the one lens coupling body 50 has been provided, a configuration in which two lens coupling bodies 50 are coupled to each other while being mutually vertically inverted may be provided.

In this case, for example, it is possible to provide an integrated position and turn lamp obtained by combining a width indicator (a position lamp) configured to emit white light and a direction indicator (a turn lamp) configured to emit blinking orange light by making emission colors of the light L emitted from the light source 2 different between the upper lens coupling body 50 and the lower lens coupling body 50.

Meanwhile, since the emission colors of the light L emitted from the light source 2 are the same between the upper lens coupling body 50 and the lower lens coupling body 50, it is also possible to perform linear emission in which an emission width in the thickness direction Z is increased.

In addition, while the lighting tool 100 for a vehicle including the lens coupling body 50 has been exemplified in the embodiment, the lighting tool for a vehicle to which the present invention is applied may include the light guide lens 1, and the light source 2 configured to emit light L toward the light incidence section 3 of the light guide lens 1.

In addition, while the case in which the present invention is applied to a front turn lamp as the lighting tool for a vehicle has been exemplified in the embodiment, the lighting tool for a vehicle to which the present invention is applied is not limited to a front lighting tool for a vehicle and, for example, the present invention may be applied to a rear lighting tool for a vehicle such as a rear combination lamp or the like.

In addition, the lighting tool for a vehicle to which the present invention is applied is not limited to a turn lamp, and for example, the present invention may be widely applied to a lighting tool for a vehicle such as a headlight (headlamp) for a vehicle, a width indicator (a position lamp), an auxiliary headlight (a subsidiary headlamp), a front (rear) fog light (fog lamp), a daytime running light (DRL), a lid lamp, a taillight (a tail lamp), a brake lamp (a stop lamp), aback lamp, or the like. In addition, colors of the light emitted from the light source 2 can also be appropriately changed according to a use thereof, being for example, white light, red light, orange light, or the like.

In addition, the light guide lens and the lens coupling body to which the present invention is applied are appropriately used in the above-mentioned lighting tool for a vehicle, and for example, may also be applied to a use in general lighting or the like other than a lighting tool for a vehicle.

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

What is claimed is:

1. A light guide lens comprising:

a light incidence section into which light emitted from a light source is incident;

a first light guide section, a second light guide section and a third light guide section that are configured to guide the light incident from the light incidence section:

a first reflecting section disposed between the first light guide section and the second light guide section and configured to reflect the light guided into the first light guide section toward the second light guide section; and a second reflecting section disposed between the second light guide section and the third light guide section and configured to reflect the light guided into the second light guide section toward the third light guide section, wherein the light incidence section is disposed on a side of the first light guide section facing the light source and configured to cause the light emitted from the light source to enter the first light guide section while being diffused in a widthwise direction, the first reflecting section reflects the light diffused and guided into the first light guide section in the widthwise direction toward the second light guide section while diffusing the light in the widthwise direction, the second reflecting section reflects the light diffused and guided into the second light guide section in the widthwise direction toward the third light guide section while parallelizing the light, in a cross section in a direction perpendicular to the widthwise direction and a direction parallel to an optical axis of the light emitted from the light source, the first reflecting section has a first reflecting surface of which an inclined angle with respect to the optical axis of the light emitted from the light source gradually reduces from a central section in the widthwise direction toward both end portions, and in a cross section in a direction parallel to the widthwise direction and a direction parallel to the optical axis of the light emitted from the light source, the second reflecting section has second reflecting surfaces which are inclined in opposite directions with each other toward one side and other side in the widthwise direction with respect to the optical axis of the light emitted from the light source and in which a plurality of reflecting cuts are periodically arranged.

2. The light guide lens according to claim 1, wherein the plurality of reflecting cuts are constituted by parabolic reflecting surfaces having focuses at different positions with each other.

3. The light guide lens according to claim 1, wherein the plurality of reflecting cuts are constituted by parabolic reflecting surfaces having a focus at the same position with each other and different F values respectively.

4. The light guide lens according to claim 1, comprises:

a light emitting section configured to emit the light, which is parallelized and guided at inside the third light guide section, toward outside.

5. A lens coupling body comprising the plurality of light guide lenses according to claim 1, wherein the plurality of light guide lenses have a structure in which they are coupled to each other at a tip side of the third light guide section in a state the plurality of light guide lenses are arranged in the widthwise direction.

6. The lens coupling body according to claim 5, comprises:

a fourth light guide section coupled to the tip side of the third light guide section in the plurality of light guide lenses, and wherein the fourth light guide section has a light emitting surface continuous in the widthwise direction and emits the light from the light emitting surface of the fourth light guide section, which is disposed on a side opposite to the tip side of the third light guide section, toward the outside.

7. A lighting tool for a vehicle comprising:

the lens coupling body according to claim 6; and a plurality of light sources that is provided to correspond to the plurality of light guide lens that constitute the lens coupling body, respectively, and that is configured to emit light toward the light incidence section of the light guide lens.

8. A lighting tool for a vehicle comprising:

the lens coupling body according to claim 5; and a plurality of light sources that is provided to correspond to the plurality of light guide lenses that constitute the lens coupling body, respectively, and that is configured to emit light toward the light incidence section of the light guide lens.

9. A lighting tool for a vehicle comprising:

the light guide lens according to claim 1; and a light source configured to emit light toward the light incidence section of the light guide lens.

* * * * *